US011192152B2

(12) United States Patent
Kunitomo et al.

(10) Patent No.: US 11,192,152 B2
(45) Date of Patent: Dec. 7, 2021

(54) CLEANING APPARATUS AND METHOD OF CLEANING AND DRYING AN OBJECT

(71) Applicant: SUGINO MACHINE LIMITED, Uozu (JP)

(72) Inventors: Daisuke Kunitomo, Uozu (JP); Toyoaki Mitsue, Uozu (JP); Toyohiro Yamauchi, Uozu (JP); Atsushi Kohama, Anjo (JP); Atsushi Yoshida, Anjo (JP)

(73) Assignee: SUGINO MACHINE LIMITED, Uozu (JP)

( * ) Notice: Subject to any disclaimer, the term of this patent is extended or adjusted under 35 U.S.C. 154(b) by 30 days.

(21) Appl. No.: 16/594,411

(22) Filed: Oct. 7, 2019

(65) Prior Publication Data

US 2020/0108424 A1 Apr. 9, 2020

(30) Foreign Application Priority Data

Oct. 9, 2018 (JP) ..... JP2018-190658

(51) Int. Cl.
*B08B 3/10* (2006.01)
*B08B 13/00* (2006.01)

(52) U.S. Cl.
CPC ..... *B08B 3/10* (2013.01); *B08B 13/00* (2013.01)

(58) Field of Classification Search
CPC ..... B08B 3/10; B08B 13/00; B08B 3/022; B08B 3/02; B08B 3/04; B08B 5/02;
(Continued)

(56) References Cited

U.S. PATENT DOCUMENTS 4,850,382 A * 7/1989 Williams ..... B05B 13/0431 134/167 R
6,215,268 B1 * 4/2001 Choi ..... B25J 21/00 318/587

(Continued)

FOREIGN PATENT DOCUMENTS

JP 6196588 B2 9/2017
JP 6227496 B2 11/2017

(Continued)

OTHER PUBLICATIONS

Extended European Search Report dated Mar. 9, 2020 in a corresponding European patent application No. 19201783.8 97 pages).

*Primary Examiner* — Michael E Barr
*Assistant Examiner* — Thomas Bucci
(74) *Attorney, Agent, or Firm* — United IP Counselors, LLC

(57) ABSTRACT

A compact versatile cell-type cleaning device and cell-type drying device is provided. A cleaning apparatus includes: a cover having a loading port formed on a wall surface of a cleaning chamber, and an unloading port formed on a wall surface of a drying chamber; a partition plate having an intermediate transfer port for dividing into the cleaning chamber and the drying chamber; an intermediate door that opens and closes the intermediate transfer port; a turntable disposed inside the drying chamber and having a first gripping device that grips an object, and a moving device having a gripping device that grips the object through a loading port, cleans the object inside the cleaning chamber while gripping the object, and moves the object to the turntable.

12 Claims, 13 Drawing Sheets

(58) Field of Classification Search
CPC ..... B08B 11/02; B08B 1/02; B08B 5/023; B08B 9/0821; B08B 9/0826
USPC ..... 134/158, 133, 902, 134, 95.2, 157, 95.3, 134/153, 198, 61, 66
See application file for complete search history.

(56) References Cited

U.S. PATENT DOCUMENTS 6,804,579 B1* 10/2004 Laski ..... B08B 3/024 318/568.11
2002/0007844 A1* 1/2002 Orii ..... B08B 3/02 134/30
2003/0024645 A1* 2/2003 Orii ..... B08B 3/02 156/345.33
2003/0034056 A1* 2/2003 Amai ..... B08B 3/04 134/93
2003/0084929 A1* 5/2003 Kamikawa ..... B08B 3/02 134/104.4
2003/0098048 A1* 5/2003 Kuroda ..... H01L 21/68728 134/32
2003/0136431 A1* 7/2003 Scranton ..... H01L 21/67046 134/63
2004/0016637 A1* 1/2004 Yang ..... A23D 7/005 204/242
2004/0020520 A1* 2/2004 Kim ..... H01L 21/67051 134/95.2
2004/0231794 A1* 11/2004 Hongo ..... H01L 21/76849 156/345.12
2004/0244824 A1* 12/2004 Yasukawa ..... B08B 3/10 134/66
2007/0125404 A1* 6/2007 Davis ..... H01L 21/67775 134/33
2008/0006306 A1* 1/2008 Leyendecker ..... B08B 9/02 134/61
2011/0000512 A1* 1/2011 Toshima ..... H01L 21/67057 134/34
2012/0006363 A1* 1/2012 Milojevic ..... B08B 3/024 134/62
2015/0040951 A1* 2/2015 Yoshizumi ..... H01L 21/67051 134/26
2015/0071742 A1* 3/2015 Matsuzawa ..... B08B 3/04 414/226.05
2015/0196938 A1* 7/2015 Sakashita ..... H01L 21/67051 134/56 R
2015/0209843 A1* 7/2015 Sakashita ..... B08B 9/205 15/304
2015/0217339 A1* 8/2015 Sakashita ..... B08B 3/08 134/115 R
2015/0217345 A1* 8/2015 Sakashita ..... B08B 3/04 134/133
2015/0270146 A1* 9/2015 Yoshihara ..... H01L 21/68742 134/18
2016/0001335 A1* 1/2016 Forster ..... B08B 3/10 134/26
2016/0008854 A1* 1/2016 Wittendorfer ..... B08B 3/024 134/58 R
2016/0023251 A1* 1/2016 Mitsue ..... B25J 21/00 134/134
2016/0023254 A1* 1/2016 Mitsue ..... B08B 3/102 269/25
2017/0072531 A1* 3/2017 Akazawa ..... B24B 9/00

FOREIGN PATENT DOCUMENTS

JP 2018-012079 A 1/2018
WO 2010/062894 A1 6/2010

* cited by examiner

CLEANING APPARATUS AND METHOD OF CLEANING AND DRYING AN OBJECT

CROSS-REFERENCE TO RELATED APPLICATIONS

This application claims the benefit of priority to Japanese Patent Application No. 2018-190658, filed on Oct. 9, 2018, the entire contents of which are hereby incorporated by reference.

BACKGROUND

1. Technical Field

The present invention relates to a cleaning apparatus and a method of cleaning and drying an object.

2. Description of the Background

Japanese Patent No. 6227496 proposes a cleaning apparatus including a cleaning area, a gripping device, a feeding device for holding and moving a workpiece so as to face the cleaning area, and a cover device. The feeding device moves the workpiece to the cleaning area for cleaning the workpiece. A feeding device for use in a cleaning apparatus have been proposed. See Japanese Patent No. 6196588 (hereinafter referred to as "Patent Literature 1", and Japanese Unexamined Patent Application Publication No. 2018-12079 (hereinafter referred to as "Patent Literature 2").

BRIEF SUMMARY

A compact cell-type cleaning device and a compact cell-type drying device with high versatility are desired.

A first aspect of the present invention is a cleaning apparatus, including:

- a cover having a cleaning chamber and a drying chamber inside, the cover having
  - a loading port formed on a wall surface of the cleaning chamber, and
  - an unloading port formed on a wall surface of the drying chamber;
- a partition plate having an intermediate transfer port, the partition plate dividing a space inside the cover into the cleaning chamber and the drying chamber;
- an intermediate door configured to open and close the intermediate transfer port;
- a turntable disposed inside the drying chamber, the turntable having a first gripping device configured to grip an object, the turntable configured to rotate to a drop position for receiving the object through the intermediate transfer port, a drying position for drying the object, and a dispensing position for dispensing the object through the unloading port; and
- a moving device disposed inside the cleaning chamber, the moving device having a second gripping device configured to grip the object through the loading port, the moving device configured to clean the object inside the cleaning chamber while gripping the object, and the moving device configured to move the object to the first gripping device through the intermediate transfer port.

A second aspect of the present invention is a method of cleaning and drying an object, the method including:

- loading, by a moving device, a first object through a loading port;

- cleaning the object with facing a nozzle ejecting a cleaning liquid;
- rotating a turntable to a drying position with a rotating plate gripping a second object;
- rotating, by the rotating plate, the second object to spin off the cleaning liquid adhering to the second object;
- rotating the turntable to a dispensing position;
- dispensing, by the rotating plate, the second object through an unloading port;
- rotating the turntable to a drop position; and
- attaching, by the moving device, the cleaned first object to the rotating plate through the intermediate transfer port.

The cleaning apparatus can handle two objects simultaneously. The first object is mounted on the second gripping device during operation and is cleaned during operation. The first object is treated as a second object in the next run. At the start of operation, the second object is mounted on the first gripping device. The second object is dried and dispensed by the operation. That is, the object loaded into the cleaning apparatus is completely cleaned and dried after two operations, and is discharged from the cleaning apparatus. The first object and the second object may be of different types.

The splash cover (hereinafter simply referred to as "cover") prevents the cleaning liquid L from leaking to the outside. The cover also serves as a safety cover.

The moving device is, for example, a vertical articulated robot or an orthogonal axis robot. The vertical articulated robot is, for example, a six-axis vertical articulated robot. The orthogonal axis robot has, for example, a three-axis linear axis and a one-axis or two-axis rotation axis. Preferably, at least one of the rotation axis rotates about a vertical direction. As the orthogonal axis robot, for example, the feeding devices described in Patent Literatures 1 and 2 may be used. The moving device grips the object at the loading position near the loading port by the second gripping device, and carries the object into the cover. The second gripping device repeatedly grips the object in the same position. For example, the second gripping device includes a positioning pin and a clamp. A part of the object in the loading position may enter into the cover from the loading port. The moving device cleans the object in the cleansing chamber while holding the object.

The cleaning chamber has a cleaning region. The cleaning region is a region where the object and the cleaning liquid are in contact with each other. For example, a plurality of cleaning nozzles are fixed in the cleaning region. The moving device moves in such a manner that the cleaning points of the object faces the plurality of cleaning nozzles. The cleaning liquid jetted from the cleaning nozzle collides with the cleaning points. Here, the cleaning point is a position of the object to be cleaned. The cleaning point is, for example, an internal thread, an oil hole, a pin hole, a water hole, or a shaving surface.

Through the intermediate transfer port, the moving device attaches the object to the first gripping device. At this time, the intermediate transfer port and the intermediate door do not interfere with the second gripping device. A part of the object attached on the first gripping device may protrude to the cleaning chamber side.

The intermediate transfer port is configured so that the turntable, the first gripping device and the object do not collide with the partition plate when the turntable is rotated. In other words, the intermediate transfer port includes an intersection of the partition plate and the rotation body obtained by rotating the turntable, the first gripping device, and the object about the pivot axis, and has a closed region wider than the intersection.

Preferably, when the turntable is rotated to the dispensing position, a part of the object attached on the first gripping device protrudes outside the cover. As a result, the width of the cleaning apparatus may be shortened. Since a part of the object protrudes to the outside of the cover, it is easy for an apparatus in the next process, for example, a dispensing apparatus or an assembling apparatus, to receive the dried object.

The unloading port is configured so that the turntable, the first gripping device and the object do not collide with the cover when the turntable is rotated. In other words, the unloading port includes an intersection of the cover and the rotation body obtained by rotating the turntable, the first gripping device, and the object about the pivot axis, and has a closed region wider than the intersection.

A loading door is provided at the loading port. The loading door is, for example, a slide door. The loading door opens and closes the loading port.

An intermediate transfer door is provided at the intermediate transfer port. The intermediate transfer door is, for example, a slide door. The intermediate transfer door opens and closes the intermediate transfer port.

An unloading door is provided at the unloading port. The unloading door is, for example, a slide door. The unloading door opens and closes the unloading port.

The turntable rotates between a drop position, a drying position, and a dispensing position. At the drop position, the first gripping device faces the intermediate transfer port. At the drop position, the moving device attaches the first object to the first gripping device. Preferably, at the drop position, the object attached on the first gripping device protrudes from the intermediate transfer port toward the cleaning chamber. At the drying position, the rotating plate is rotated to dehydrate the second object. At the dispensing position, the first gripping device faces the unloading port. At the dispensing position, the second object is dispensed to the next process. Preferably, at the dispensing position, the object attached on the first gripping device protrudes out of the cover from the unloading port. Preferably, the turntable is rotated by a servomotor. The turntable may be rotated and positioned by a cam unit.

The turntable allows the first gripping device to easily receive the object in a state in which it protrudes to the cleaning chamber side, and the first gripping device to easily dispense the object in a state in which it protrudes to the unloading port.

A combination of a turntable and centrifugal dehydration of the object is preferred. The moving device drops the object to the first gripping device with the center axis of the rotating plate directed to the intermediate transfer port, and the turntable is rotated so that the center axis is directed to the unloading port and the first gripping device releases the object to be dispensed to the next process.

A rotatably supported rotation shaft is disposed on the turntable. A support cylinder may be disposed on the turntable. The rotation shaft is supported by a support cylinder with a bearing. The rotating plate may be fixed to one of the rotation shafts. The rotating plate forms part of the first gripping device. A clamp is disposed on the rotating plate. Positioning pins and seating pins may be provided on the rotating plate.

The cleaning apparatus may include a blower. The blower may be utilized with an inner fixed nozzle or an outer fixed nozzle. The blower blows dry air. The inner fixed nozzle or the outer fixed nozzle ejects dry air.

The inner fixed nozzle and the fixed shaft are used in combination. When the inner fixed nozzle is used, the rotation axis is hollow cylindrical. A fixed shaft is provided so as to pass through the inside of the rotation shaft. The inner fixed nozzle may be arranged on one end side of the fixed shaft. An inner passage of dry air is provided inside the fixed shaft. The inner passage connects the blower and the inner fixed nozzle.

Preferably, the inner fixed nozzle extends along a rotation axis. The inner fixed nozzle ejects dry air radially outward. The inner fixed nozzle may be a slit nozzle. The rotation shaft of the hollow shaft, the fixed shaft inside the rotation shaft, and the inner fixed nozzle are used in combination. The inner fixed nozzle blows the inside of the object. The dry air jet from the inner fixed nozzle contacts the inner surface of the object as the object rotates. The cleaning liquid or the like adhering to the inner surface of the object is blown off by the dry air jet from the inner fixed nozzle.

The outer fixed nozzle is arranged on a mounting plane passing through the axis line. The outer fixed nozzle is arranged outside the trajectory in which the first gripping device and the object rotate. The outer fixed nozzle does not interfere with the rotating first gripping device and the object. The outer fixed nozzle is provided along the contour of the shape obtained by rotating the first gripping device and the object about the rotation axis. A plurality of outer fixed nozzles may be provided. Preferably, the outer fixed nozzle is provided without a gap over a half circumference from the outer circumference of the outer shape to the rotation center axis. Instead of the plurality of the outer fixed nozzle, a slit nozzle may be provided. The outer fixed nozzle is connected to the blower via an outer passage.

The outer fixed nozzle may be arranged with the inner fixed nozzle. Instead of arranging the inner fixing nozzle, only the outer fixed nozzle may be arranged. For bowl-shaped objects, both the outer and inner fixed nozzles are preferably used.

The first gripping device may include a clamp having a fluid cylinder. The driving fluid of the fluid cylinder may utilize compressed air. A rotary fluid coupling may be disposed at the other end of the rotation shaft. The rotary fluid coupling has a fixed housing in sliding contact with a cylindrical surface, which is an outer surface of the rotation shaft, in the rotational direction. The fixed housing has a hollow cylindrical shape. An annular passage is disposed between the fixed housing and the rotation shaft. The first passage is disposed in the fixed housing. The first passage connects the compressed air source and the annular passage. The second passage is disposed on the rotation shaft. The second passage connects the annular passage and the fluid cylinder.

Instead of the toothed belt mechanism, a gear mechanism may be used. With the toothed belt mechanism, the rotational phase of the rotating plate is accurately controlled because there is no backlash. The gear mechanism is, for example, a non-backlash gear mechanism.

The cleaning apparatus has high versatility. The cleaning apparatus loads a plurality of types of objects one after another, and cleans them by a program corresponding to the type of the objects. The cleaned object is transferred to the drying chamber. The cleaning apparatus dries optimally depending on the type of object. After the drying, the object is unloaded from the unloading port.

The moving device grips the object loaded from the loading port, takes it into the cleaning chamber while freely moving it, cleans it while gripping, and attaches it to the drying device as it is after cleaning. No conveying device is included between the cleaning device and the drying device. The moving device has high versatility because it can freely move the object relative to the nozzle and change the attitude. Since it can be attached on the drying device without passing through the conveying device, the installing area is reduced. Since the object can be attached to the drying device without passing through the conveying device, foreign matter does not easily adhere to the object after cleaning. The gripping device of the drying device is less susceptible to contamination. It is possible to suppress contamination of the object after cleaning through the gripping device of the drying device. There has not been a combined device that integrally includes a cleaning device and a drying device, and that only requires two sets of space, one for a cell-type cleaning device and the other for a cell-type drying device.

Since the object can be loaded in a state in which about half of the object is protruded from the loading port, the object can be directly introduced into the cleaning apparatus in the preceding process. For example, it is possible to directly input the processed object to the cleaning apparatus in the preceding process without using the conveying device.

Since the object is unloaded so as to protrude by about half from the unloading port, the next process can easily receive the unloaded object. For example, the device of the next process may be provided with its safety cover in contact with the cover of the present application and may receive the object inside the device of the next process.

The loading of the first object from the loading port by the moving device may be performed simultaneously with rotating the turntable to the drying position. Preferably, the cleaning of the first object by the moving device is performed simultaneously with the rotation of the second object by the rotating plate, i.e. the dehydration of the second object. Preferably, the time to clean the first object and the time to dehydrate the second object are substantially the same.

The operations of rotating the turntable to the dispensing position, dispensing the second object by the rotating plate, rotating the turntable to the drop position, and attaching the first object after cleaning to the rotating plate by the moving device are performed in sequence.

The loading door is closed after loading the first object and before the nozzle ejects the cleaning liquid. The intermediate transfer door is closed after the turntable is rotated to the drying position and before the nozzle ejects the cleaning liquid. The unloading door may be closed after the turntable is rotated to the drop position. The unloading door may be closed after starting the operation and before starting the rotation of the object. The loading door and the intermediate transfer door may be closed simultaneously.

The loading door, the intermediate transfer door and the unloading door may be closed simultaneously after the object is loaded and the turntable is rotated to the drying position, and before the moving device cleans the object and rotates the object for drying. Closing the three doors simultaneously simplifies the procedure. Preferably, the time for opening the loading door, the intermediate transfer door and the unloading door is substantially the same.

The loading door may be opened after stopping the injection of the cleaning liquid. The intermediate transfer door may also be opened after stopping the injection of the cleaning liquid. The unloading door is opened before the turntable is rotated to the dispensing position and after stopping the rotation of the object and the air blow. The intermediate transfer door and the loading door may be opened simultaneously.

The loading door, the intermediate transfer door and the unloading door may be opened simultaneously after the object is cleaned and dried, and before the turntable is rotated to the dispensing position. Opening three doors simultaneously simplifies the procedure. Preferably, the time for closing the loading door, the intermediate transfer door and the unloading door is substantially the same.

Blowing from the fixed nozzle may flow inside the object. The dry air may be ejected radially outward from an inner fixed nozzle provided on the center axis of the rotation shaft. Dry air is blown from the inside of the object in a fixed direction. Since the object rotates about the rotation axis, the object is blown in the entire circumferential direction inside the object as the object rotates.

The blowing from the fixed nozzle may flow outside the object. The dry air may be ejected radially inward from an outer fixed nozzle provided in an installation plane including the center axis of the rotation axis. Dry air may be ejected from an outer fixed nozzle provided in the installation plane in the axial direction of the center axis toward the surface of the object. Since the object rotates about the rotation axis, the object is blown in the entire circumferential direction of the outside of the object as the object rotates.

Fixed blowing from the inside and fixed blowing from the outside may be performed in combination.

Preferably, the air in the drying chamber is exhausted to the outside of the drying chamber. During drying of the object, the washing liquid mist fills the drying chamber. When the intermediate transfer door is opened, the mist in the cleaning chamber enters the drying chamber. Drying is promoted by exhausting the mist in the drying chamber. Preferably, the air in the cleaning chamber is also exhausted to the outside of the cleaning chamber. When the cleaning liquid is jetted from the nozzle to collide with the object, a mist of the cleaning liquid is generated and filled in the cleaning chamber. Exhausting the mist tends to improve the cleanliness.

The washing of the first object refers to an operation from the start of putting the loaded object into the cleaning area to the end of the cleaning. The maximum time for ejecting the cleaning liquid is from the end of closing both the loading door and the intermediate transfer door to the start of opening either the loading door or the intermediate transfer door. During this cleaning time, the cleaning liquid jet impinges on the object.

The drying of the second object refers to the operation from the start of the rotation of the object to the stop of the rotation. At the same time, air blowing may be performed on the second object. The blowing of the second object is performed between the start of rotation and the stop of rotation of the object. The maximum time for drying the second object is time while the turntable is in the drying position, the intermediate transfer door is closed, and the unloading door is closed. Preferably, the time to clean the first object and the time to dry the second object are substantially the same.

Preferably, when the rotation of the second object is stopped, the rotating plate is stopped in accordance with a preset rotation phase. Preferably, the rotation phase of the rotating plate is maintained as the turntable rotates.

It is desirable that the object after cleaning in the cleaning device does not come into contact with the gripping device or the conveyor. In the cleaning method of the present application, an object is cleaned while being picked up, and is directly held by a gripping device of a drying device. Therefore, it is possible to suppress foreign matter from adhering to the cleaned object due to other gripping devices gripping the object or coming into contact with the conveyor. Then, the dried object is directly unloaded simply releasing the object by the gripping device. The next step is to directly receive the object without touching anything with the drying completed. Since the cleaning apparatus unload the object by protruding from the unloading port, the object may easily be received in the next process.

According to the present invention, a highly versatile and compact cleaning apparatus is provided without separately providing a conveyer between the cleaning device and the drying device.

DETAILED DESCRIPTION

The cleaning apparatus 10 according to an embodiment will be described with reference to the drawings. Hereinafter, the first gripping device is referred to as a jig. The second gripping device is referred to as a hand. The readings for the hand and jig are for convenience only, and there is no substantial difference.

Figure 1:
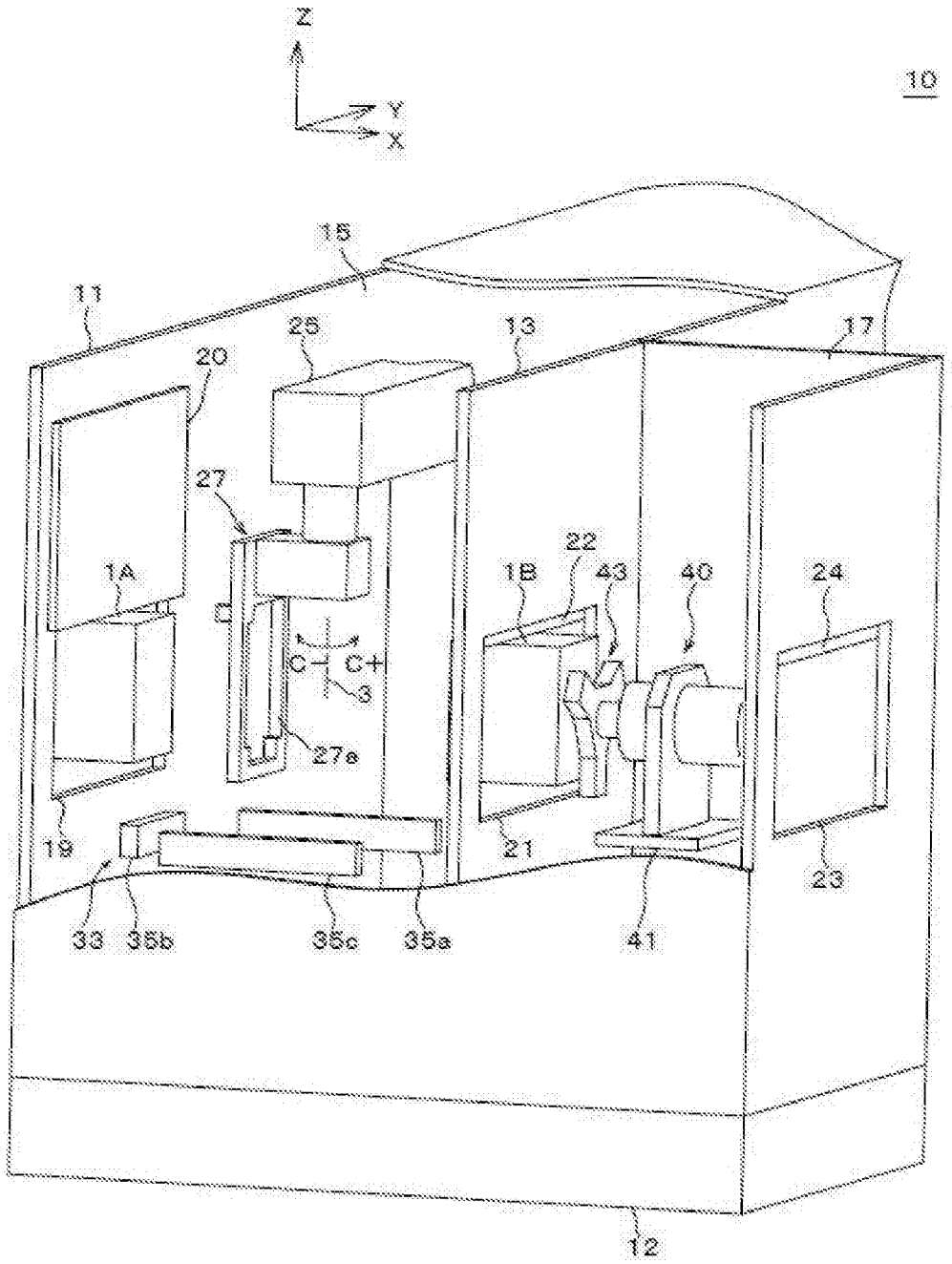
FIG. 1 is a perspective view of a cleaning apparatus of an embodiment.

As shown in FIG. 1, the cleaning apparatus 10 includes a cover 11, a loading port 19, a partition plate 13, an intermediate transfer port 21 (hereinafter referred to as a "carry-in port 21"), a unloading port 23, a quill 25 as a moving device, a hand 27, a turntable 41 (hereinafter referred to as a "table 41"), and a drying unit 40. The drying unit 40 includes a jig 43. The cleaning apparatus 10 may include a loading door 20 (hereinafter referred to as "door 20"), an intermediate door 22 (hereinafter referred to as "door 22"), a unloading door 24 (hereinafter referred to as "door 24"), nozzle blocks 35*a*, 35*b* and 35*c* (hereinafter referred to as "blocks 35*a*, 35*b*, and 35*c*"), and nozzles 37*a*, 37*b*, and 37*c*.

Figure 2:
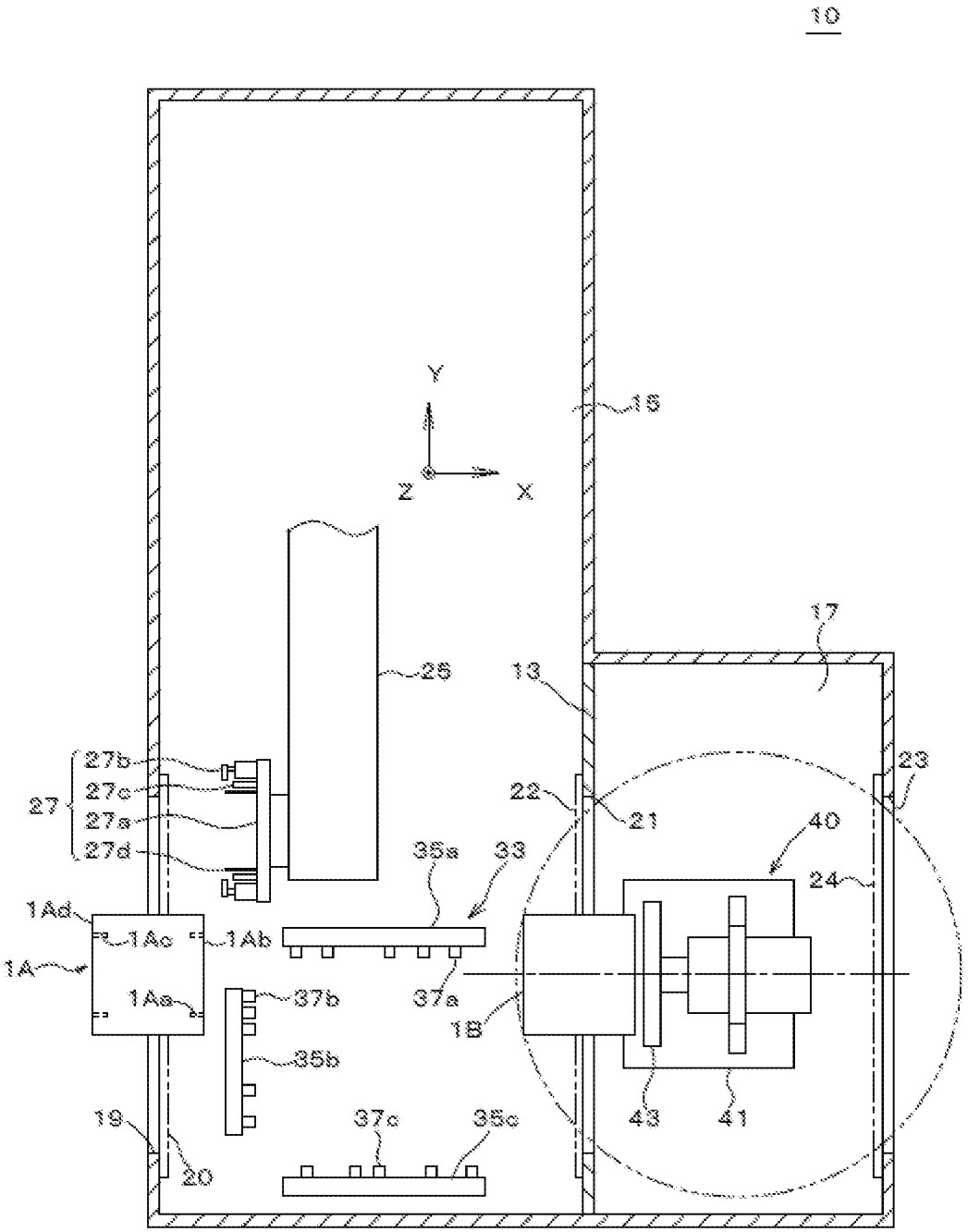
FIG. 2 is a plan view of the cleaning apparatus of the embodiment.

As shown in FIG. 2, each of a first object 1A and a second object 1B has pin holes 1Aa, 1Ac and seating surfaces 1Ab, 1Ad. The pin hole 1Aa and the seating surface 1Ab fit into the hand 27. The pin hole 1Ac and the seating surface 1Ad fit into the jig 43. Hereinafter, the first object 1A and the second object 1B may be collectively referred to as an object 1.

The cover 11 surrounds the entire cleaning apparatus 10. The cover 11 is L-shaped in plan view. The cover 11 has a frame 12.

The partition plate 13 divides the cover 11 into a cleaning chamber 15 and a drying chamber 17. Each of the cleaning chamber 15 and the drying chamber 17 has, for example, a rectangular shape in plan view. The partition plate 13 prevents the cleaning liquid L from entering the drying chamber 17.

The partition plate 13 has a intermediate transfer port 21. The object 1B moves from the cleaning chamber 15 to the drying chamber 17 through the intermediate transfer port 21. The intermediate transfer port 21 has a size sufficient to prevent the object 1B and the jig 43 from colliding with the partition plate 13 when the table 41 is rotated.

The door 22 is provided in the intermediate transfer port 21. The door 22 of the present embodiment slides in the vertical direction. The door 22 closes the intermediate transfer port 21 when moving downward, and opens the intermediate transfer port 21 when moving upward.

The cover 11 has a loading port 19 in the cleaning chamber 15. The loading port 19 is formed on a wall surface of the cleaning chamber 15. Preferably, the loading port 19 is formed on the front (near side in FIG. 1) or the lateral side (left side in FIG. 1) of the cleaning apparatus 10. The object 1A moves from the outside of the cleaning chamber 15 to the inside of the cleaning chamber 15 through the loading port 19.

The shape of the wall surface of the cleaning chamber 15 is not particularly limited, and for example, the wall surface may be a curved surface. Further, the position of the loading port 19 is not particularly limited, and for example, the loading port 19 may be formed on the rear surface (back side in FIG. 1) of the cleaning apparatus 10.

The door 20 is provided at the loading port 19. The door 20 of the present embodiment slides in the vertical direction. The door 20 closes the loading port 19 when moving downward, and opens the loading port 19 when moving upward.

The cover 11 has a unloading port 23 in the drying chamber 17. The unloading port 23 is formed on the wall surface of the drying chamber 17. Preferably, the unloading port 23 is provided on the front or lateral side (right side in FIG. 1) of the cleaning apparatus 10. The unloading port 23 has such a size that the object 1B and jig 43 do not collide with the cover 11 when the table 41 is rotated. The object 1B moves from the drying chamber 17 to the outside of the drying chamber 17 through the unloading port 23.

The shape of the wall surface of the drying chamber 17 is not particularly limited, and for example, the wall surface may be a curved surface. In addition, the position of the unloading port 23 is not particularly limited, and for example, the unloading port 23 may be provided on the rear side (back side in FIG. 1) of the cleaning apparatus 10.

Further, the loading port 19 and the unloading port 23 are not necessarily formed on opposing wall surfaces, and, for example, the loading port 19 and the unloading port 23 may be formed on adjacent wall surfaces. The loading port 19 and the unloading port 23 may be formed at corners so as to include adjacent wall surfaces.

The door 24 is provided at the unloading port 23. The door 24 of the present embodiment slides in the vertical direction.

The door 24 closes the unloading port 23 when moving downward, and opens the unloading port 23 when moving upward.

The moving device is, for example, a quill 25 with a hand 27. The quill 25 freely moves in the front-rear direction (Y direction), the left-right direction (X direction), and the vertical direction (Z direction). The quill 25 freely rotates the hand 27 about the rotation shaft 3 extending in the vertical direction, and positions the hand 27 in the rotation direction (C− direction, C+ direction). The hand 27 is provided at the distal end of the quill 25. The hand 27 grips the object 1A. The quill 25 may rotate the hand 27 about a rotation shaft (not shown) extending in the front-rear direction or the left-right direction. The axis names (X, Y, Z, C, V) may be changed.

As shown in FIG. 2, the hand 27 has a plate 27*a*, a clamp 27*b*, a seating pin 27*c*, and a positioning pin 27*d*. Preferably, the plate 27*a* has an opening 27*e*, see FIG. 1. The opening 27*e* exposes the object 1A. The pin 27*c* abuts the seating surface 1Ab. The pins 27*c* stably support the object 1A on the plates 27*a*. The pins 27*c* position the object 1A vertically relative to the plates 27*a*. Clamp 27*b* secures the object 1A to plates 27*a*. The pin 27*d* fits into the pin hole 1Aa. The pins 27*d* position the object 1A along the plane of the plates 27*a*. Clamp 27*b* may include a pneumatic cylinder, a link and an arm.

As shown in FIGS. 1 and 2, the cleaning chamber 15 has a cleaning region 33 at the front. The block 35*a* extends in the left-right direction behind the region 33. The block 35*a* has a plurality of nozzles 37*a* on the front surface for jetting the cleaning liquid in the forward direction. The block 35*b* extends in the front-rear direction to the left of the region 33. The block 35*b* has a plurality of nozzles 37*b* on the right surface for jetting the cleaning liquid rightward. The block 35*c* extends in the left-right direction in front of the region 33. The block 35*c* has a plurality of nozzles 37*c* on the rear surface for jetting the cleaning liquid backward.

Nozzle blocks may be provided on the right, upper, and lower sides of the region 33, respectively. The left surface of the right block may be provided with nozzles which jet leftward. The lower surface of the upper block may be provided with nozzles which jet downwardly. The upper surface of the lower block may be provided with nozzles which jet upward.

Figure 3:
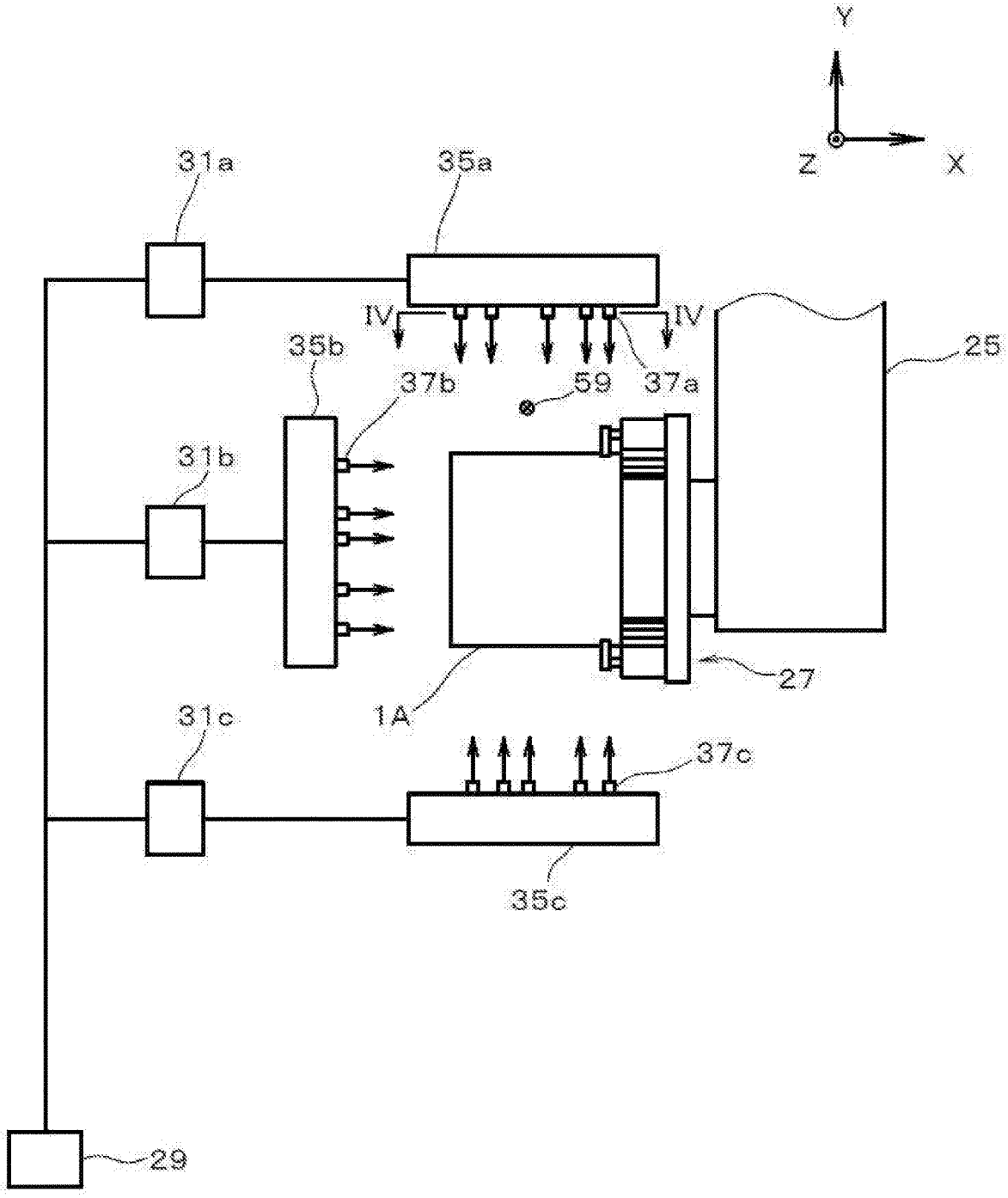
FIG. 3 is a plan view of a cleaning chamber of the embodiment showing a state of cleaning.

As shown in FIG. 3, the cleaning apparatus 10 includes a pump 29. The cleaning apparatus 10 has the same number of on-off valves 31*a*-31*c* as the blocks 35*a*-35*c*. The blocks 35*a* to 35*c* are connected to the pump 29 via valves 31*a* to 31*c*, respectively. The valves 31*a* to 31*c* may be opened and closed at different timings. For example, when the valve 31*a* is open, the valves 31*b*, 31*c* may be closed.

Figure 4A:
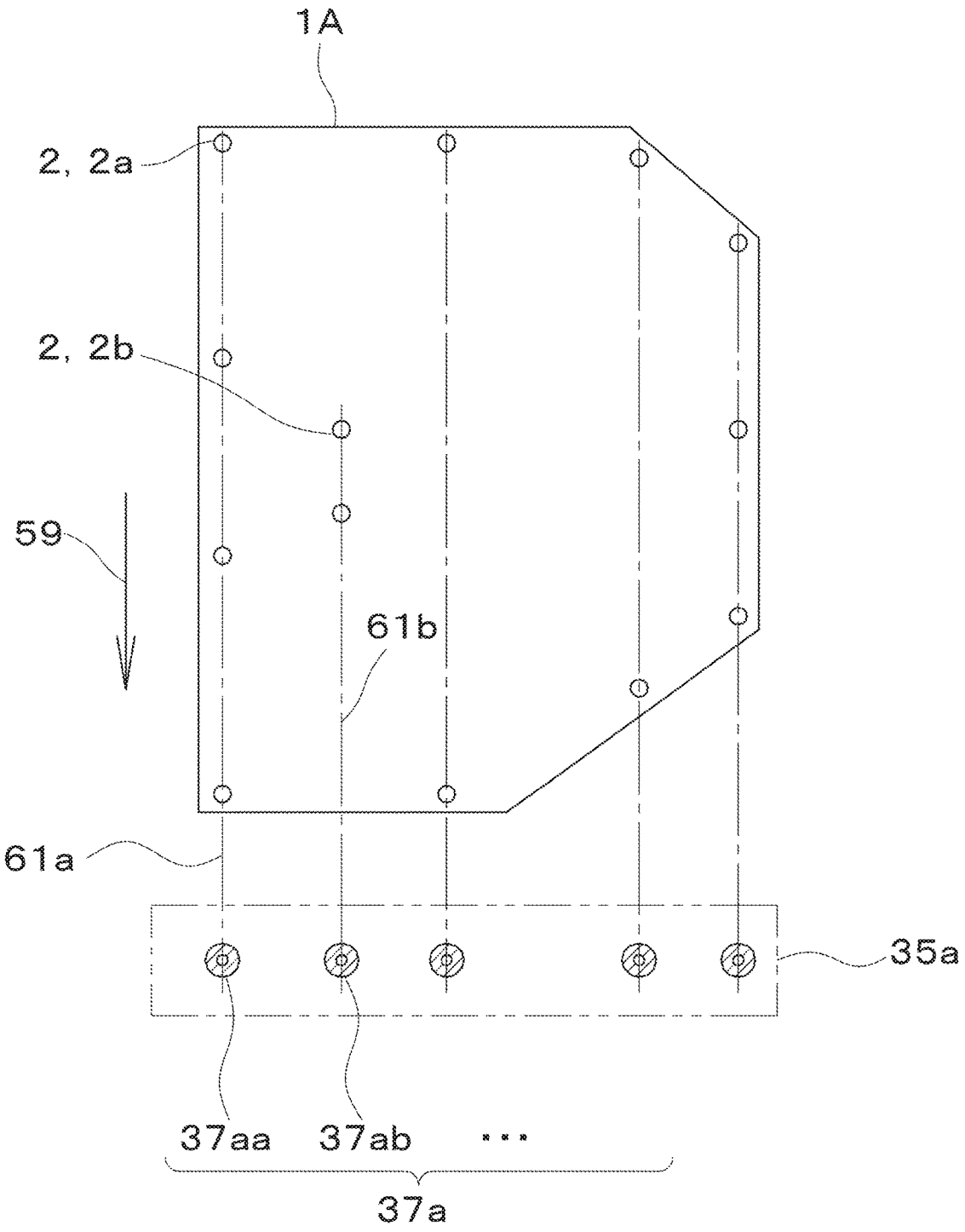
FIG. 4A is a cross-sectional view taken along the IV-IV line in FIG. 3

As shown in FIG. 4A, the object 1A has a plurality of cleaning points 2. The block 35*a* in FIG. 4A is shown by two-dot chain lines because it is actually on the back of the cross-sectional line IV-IV. Preferably, the nozzles 37*a* are disposed one-dimensionally at a position corresponding to the cleaning point 2. For example, the quill 25 moves the object 1A along arrow 59. At this time, the nozzle 37*aa* is arranged on the trajectory 61*a* of the cleaning point 2*a*. Similarly, the nozzle 37*ab* is arranged on the trajectory 61*b* of the cleaning point 2*b*. When the object 1A moves along the trajectory 59, the nozzles 37*a* are arranged on the trajectory 61 of the cleaning points 2.

Figure 4B:
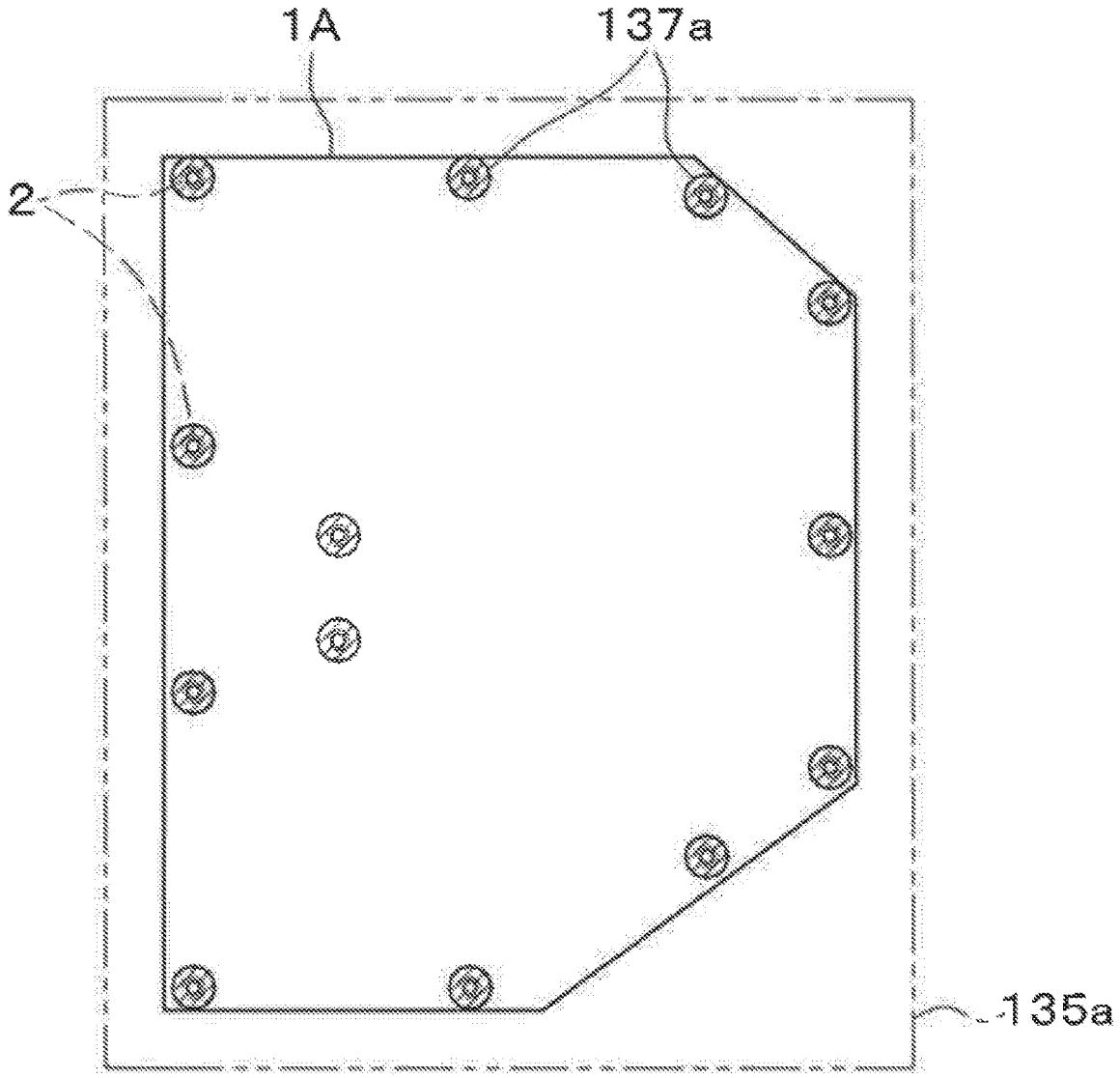
FIG. 4B shows a modification of the nozzle blocks of the embodiment.

Instead of the block 35*a*, a block 135*a* shown in FIG. 4B may be used. FIG. 4B is a cross-sectional view taken along the cross-sectional line IV-IV of FIG. 3, showing the quill 25 moving the object 1A to the cleaning position. The outline of the block 135*a* is indicated by a two-dot chain line. In the block 135*a*, the nozzles 137*a* are two-dimensionally arranged so as to coincide with a plurality of cleaning points 2. All the nozzles 137*a* are connected to the valve 31*a*, and simultaneously inject the cleaning liquid. According to the block 135*a*, all the cleaning points 2 disposed on the Y-axis positive-direction sides of the object 1A are cleaned at the same time, so that the cleaning time can be further shortened. In addition, since the object 1A need only be aligned with the block 135*a*, and the object 1A need not be moved in alignment with the nozzles 37*a*, the cleaning chamber 15 is configured more compactly.

The arrangement of the nozzles 37*b* and 37*c* is substantially the same as that of the nozzle 37*a*. That is, the nozzles are arranged in accordance with the arrangement of the cleaning points 2 on the surface of the object 1A on which the nozzles clean and the moving trajectory of the object 1A.

When the nozzles 37*a* to 37*c* are arranged on the trajectory of the cleaning points, a plurality of cleaning points are simultaneously cleaned. Therefore, the cleaning time of the cleaning apparatus 10 is shortened.

Figure 5:
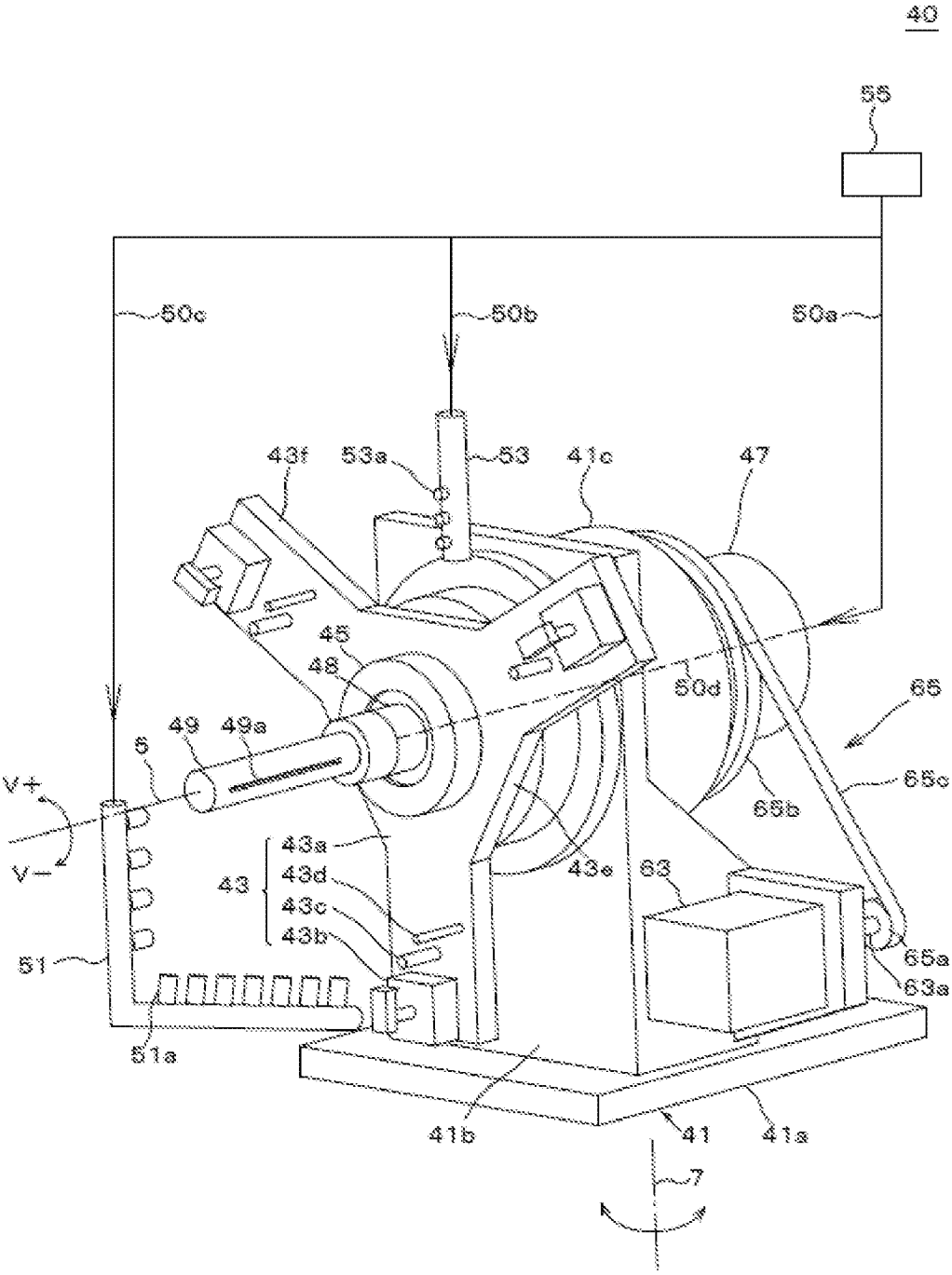
FIG. 5 is a perspective view of a drying unit of the embodiment.

FIG. 5 shows the drying unit 40 arranged in the drying position 67. As shown in FIG. 5, the drying unit 40 includes a table 41, a rotation shaft 45, a motor 63, and a toothed belt mechanism 65. The drying unit 40 may include a fluid rotary joint 47 (hereinafter referred to as a "rotary joint 47"), a fixed shaft 48, a blower 55, an inner fixed blow nozzle 49 (hereinafter referred to as a "nozzle 49"), an outer nozzle pipe 51 (hereinafter referred to as a "pipe 51"), an outer blow nozzle 51*a* (hereinafter referred to as a "nozzle 51*a*"), a rear nozzle 53*a* (hereinafter referred to as a "nozzle 53*a*"), and a rear nozzle pipe 53 (hereinafter referred to as a "pipe 53").

The table 41 has a bottom plate 41*a*, a vertical plate 41*b*, and a support cylinder 41*c*. The bottom plate 41*a* is rotatably supported by the frame 12. The vertical plate 41*b* may be arranged to be bent by a plurality of plates. The support cylinder 41*c* is disposed in the horizontal direction. The support cylinder 41*c* has a hollow cylindrical shape.

As shown in FIG. 5, the rotation shaft 45 is supported inside the support cylinder 41*c* by a bearing. The rotation shaft 45 penetrates the support cylinder 41*c*. The rotation shaft 45 is supported rotatably about a center axis 5 arranged in the horizontal direction.

The jig 43 includes a rotating plate 43*a*, a clamp 43*b*, a seating pin 43*c*, and a positioning pin 43*d*.

The rotating plate 43*a* is fixed to the first end of the rotation shaft 45. Here, the first end means a direction of the intermediate transfer port 21 when it is in the drop position 71, that is, a leftward direction in FIG. 2 and a downward oblique leftward direction in FIG. 5. The rotating plate 43*a* rotates integrally with the rotation shaft 45. The plate 43*a* may include a center plate 43*e* and a plurality of extension plates 43*f*. The center plate 43*e* is provided at the center of the center axis 5. The center plate 43*e* of the present embodiment has a triangular shape. The extension plate 43*f* is in the form of an elongated rod, and extends radially from the apex of the center plate 43*e*. The center plate 43*e* and the extension plate 43*f* may be integrally formed.

The clamp 43*b*, the pin 43*c*, and the pin 43*d* are provided at the distal end portion of the extension plate 43*f*. The clamp 43*b*, the pin 43*c*, and the pin 43*d* are arranged so as to face the intermediate transfer port 21 in the drop position 71. The clamp 43*b* clamps the object 1B. The pins 43*c* abut against the seating surface 1Ad of the object 1B. The pin 43*d* fits into the pin hole 1Ac of the object 1B.

The rotary joint 47 is provided at the second end of the rotation shaft 45. The rotary joint 47 supplies the driving fluid, for example, compressed air, of the clamp 43*b* from the outer surface side thereof through the rotation shaft 45.

The motor 63 is fixed to the vertical plate 41*b*. The motor 63 is preferably a servomotor. The output shaft 63*a* of the motor 63 is parallel to the center axis 5. The motor 63 and the rotation shaft 45 are connected by a toothed belt mechanism 65. The toothed belt mechanism 65 includes a drive toothed pulley 65*a*, a driven toothed pulley 65*b*, and an endless toothed belt 65*c*. The pulley 65*a* is fixed to the shaft 63*a*. The pulley 65*b* is fixed to the rotation shaft 45. The toothed belt mechanism 65 is a speed reduction mechanism. The motor 63 rotates only when the table 41 is in the drying position 67. The motor 63 rotates the jig 43 in the V+ or V− direction via the toothed belt mechanism 65. The motor 63 may rotate in only one of the V+ and V− directions.

The rotation shaft 45 is supported at its inner side by a fixed shaft 48 by bearings. The fixed shaft 48 is fixed coaxially with the rotation shaft 45. Preferably, the fixed shaft 48 passes through the rotary joint 47.

The nozzle 49 is fixed to the distal end portion of the fixed shaft 48. The nozzle 49 extends along the center axis 5. Preferably, the nozzle 49 has a slit 49*a*. The fixed shaft 48 internally has a passage 50*d* along the center axis 5. The passage 50*d* is connected to the nozzle 49. The passage 50*a* is an external pipe. The passage 50*a* connects the blower 55 and the passage 50*d*.

The fixed shaft 48 or the nozzle 49 passes through the plate 43*a*.

The pipe 51 and the nozzles 51*a* are arranged on an installation plane passing through the center axis 5. The pipe 51 and the nozzles 51*a* are arranged so as not to collide with the object 1B and the jig 43 when the object 1B and the jig 43 are rotated. That is, the pipe 51 and the nozzles 51*a* are disposed outside the closed area obtained by rotating the object 1B and the jig 43. Preferably, the pipe 51 is arranged along the outer surface of the object 1B. The pipe 51 of the present embodiment is L-shaped. The pipe 51 extends on one side in the radial direction from the center axis 5, bends at position away from the center axis 5, and extends in the axial direction of the center axis 5. The pipe 51 is fixed to the table 41 or the frame 12.

A plurality of nozzles 51*a* are provided along the pipe 51. The nozzles 51*a* are arranged facing the object 1B.

The pipe 53 is provided on the back surface of the plate 43*a*. The pipe 53 extends in the radial direction of the center axis 5. In FIG. 5, the pipe 53 extends in the vertical direction. The pipe 53 is fixed to the table 41 or the frame 12. Nozzles 53*a* are provided on one side of the pipe 53. The nozzles 53*a* are connected to a blower 55 via the pipe 53 and the passage 50*b*. The nozzles 53*a* blow the object 1B from the back surface of the plates 43*a*.

Figure 6A:
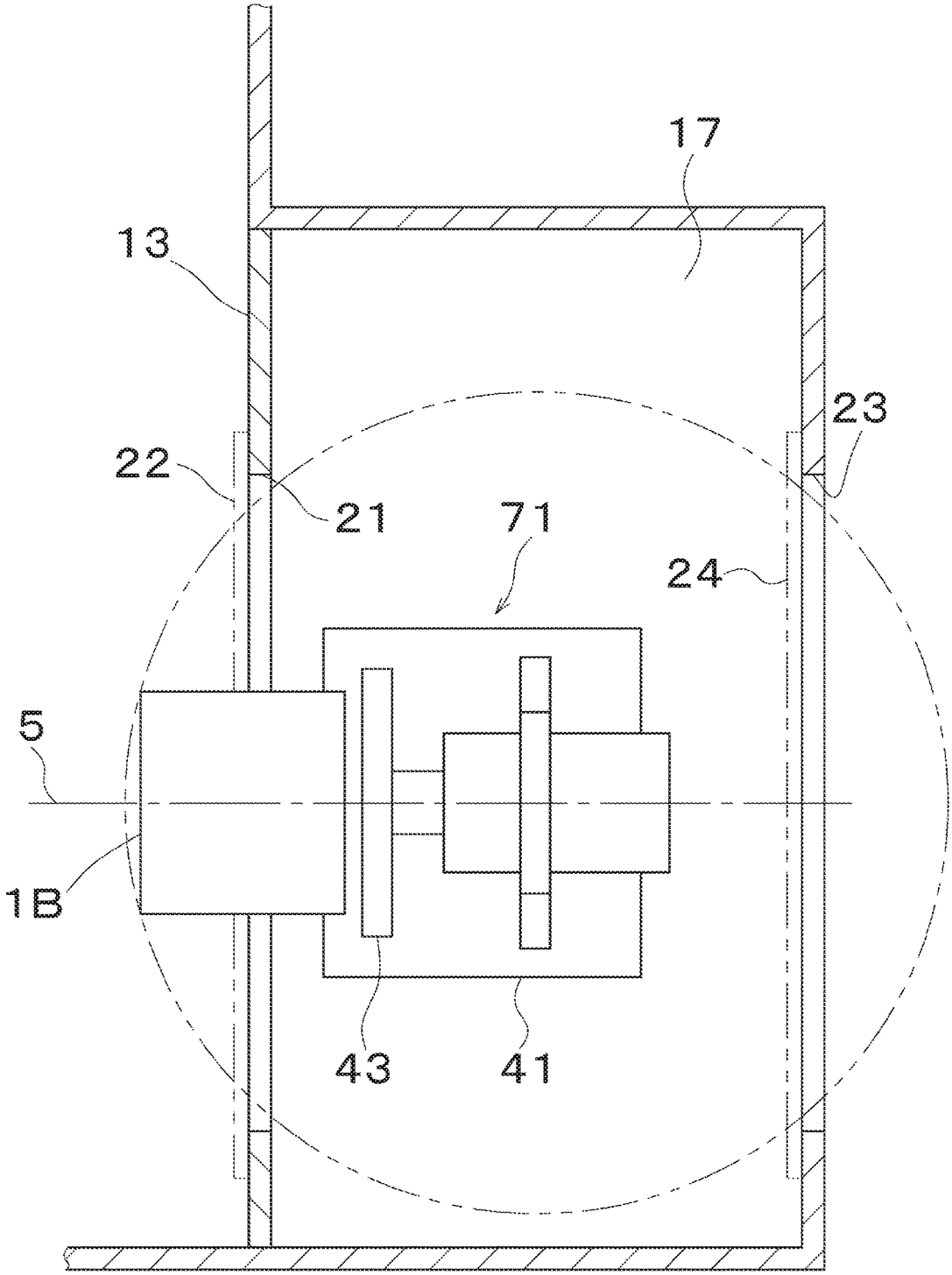
FIG. 6A is a partial plan view of the cleaning apparatus of the embodiment showing the turntable in a drop position.
Figure 6B:
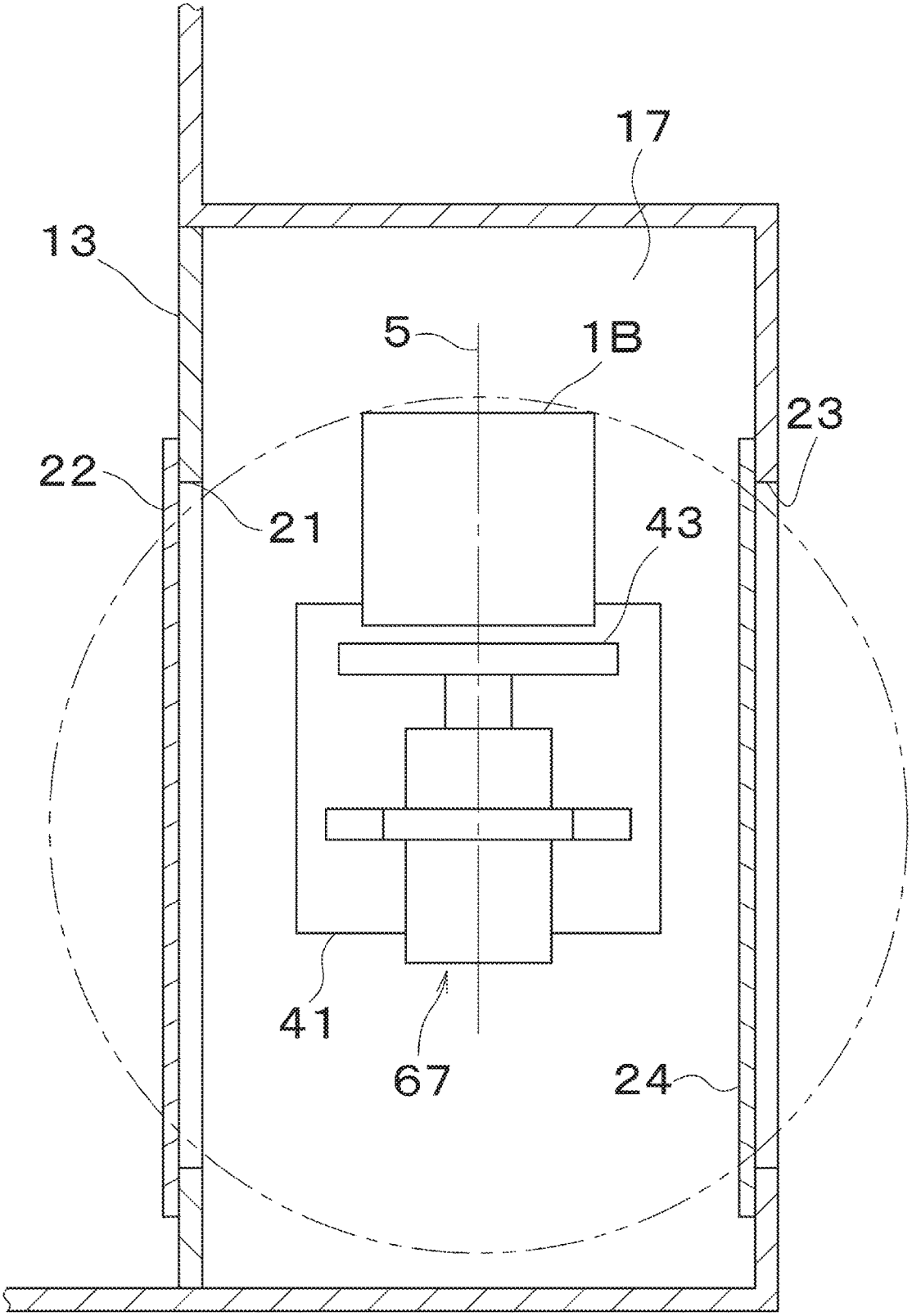
FIG. 6B is a partial plan view of the cleaning apparatus of the embodiment showing the turntable in a drying position.
Figure 6C:
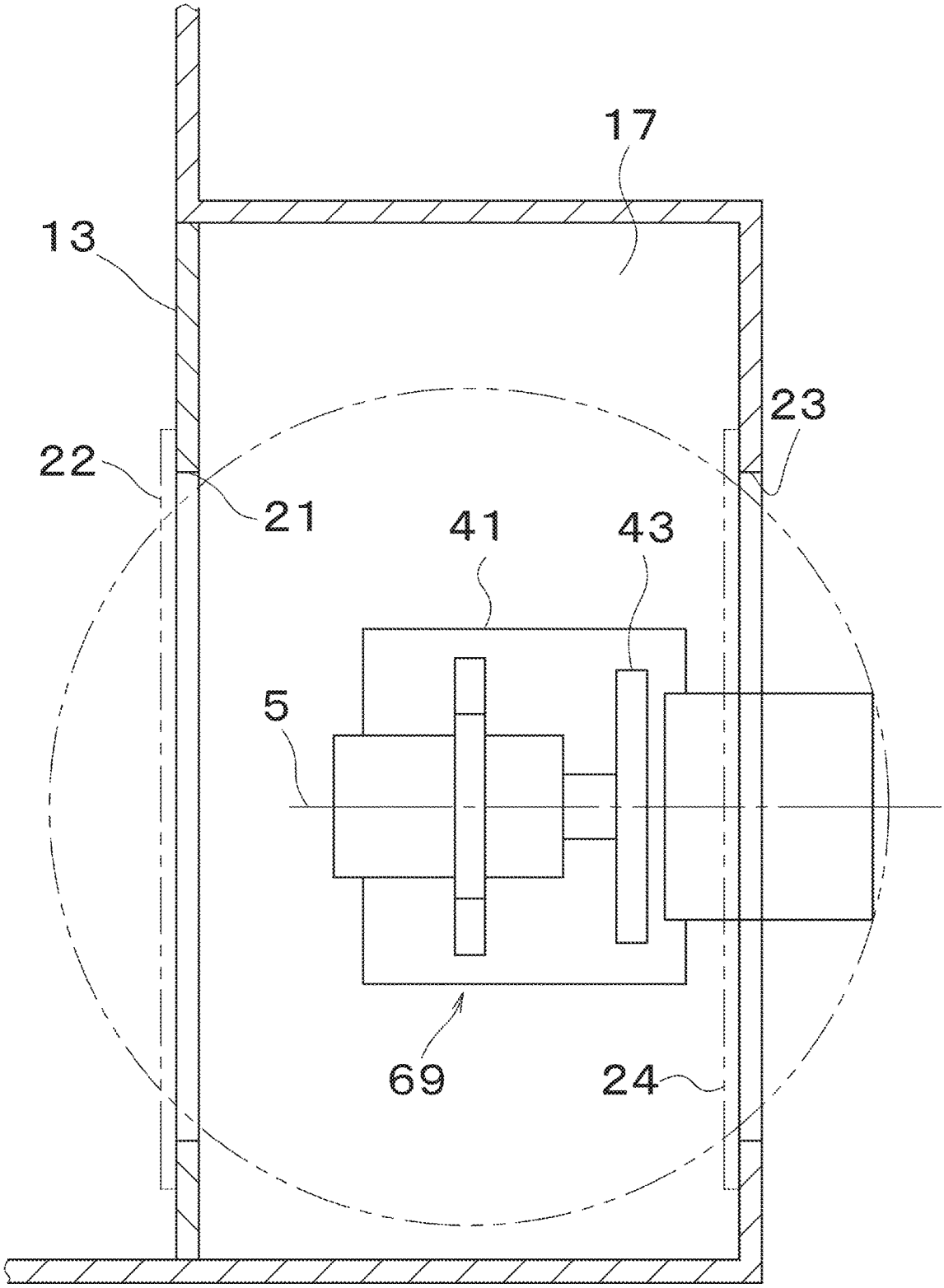
FIG. 6C is a partial plan view of the cleaning apparatus of the embodiment showing the turntable in a dispensing position.

As shown in FIGS. 2, 5 and 6A to 6C, the table 41 rotates about the pivot 7. The table 41 rotates between a drop position 71, a drying position 67 and a dispensing position 69. As shown in FIG. 6A, at the drop position 71, the jig 43 faces the intermediate transfer port 21. When the object 1B is mounted on the jig 43 at the drop position 71, the object 1B protrudes from the intermediate transfer port 21 to the cleaning chamber 15. The drop position 71 is a position at which the quill 25 inserts the object 1B into the jig 43. As shown in FIG. 6B, the drying position 67 is a position at which the object 1B is dried. For example, the drying position 67 is a position rotated by 90 degrees clockwise from the drop position when viewed from above. In the drying position 67, the jig 43 rotates with the object 1B, and the cleaning liquid adhering to the object 1B is spun off by centrifugal force. As shown in FIG. 6C, the dispensing position 69 is a position at which the object 1B is dispensed to the subsequent process. For example, the dispensing position 69 is a position rotated 180 degrees from the drop position 71. At the dispensing position 69, the object 1B faces the unloading port 23. At the dispensing position 69, the object 1B protrudes from the unloading port 23 to the outside of the cover 11. In the dispensing position 69, the plate 43*a* may be parallel to the movement axis of the apparatus in the next process.

Figure 7A:
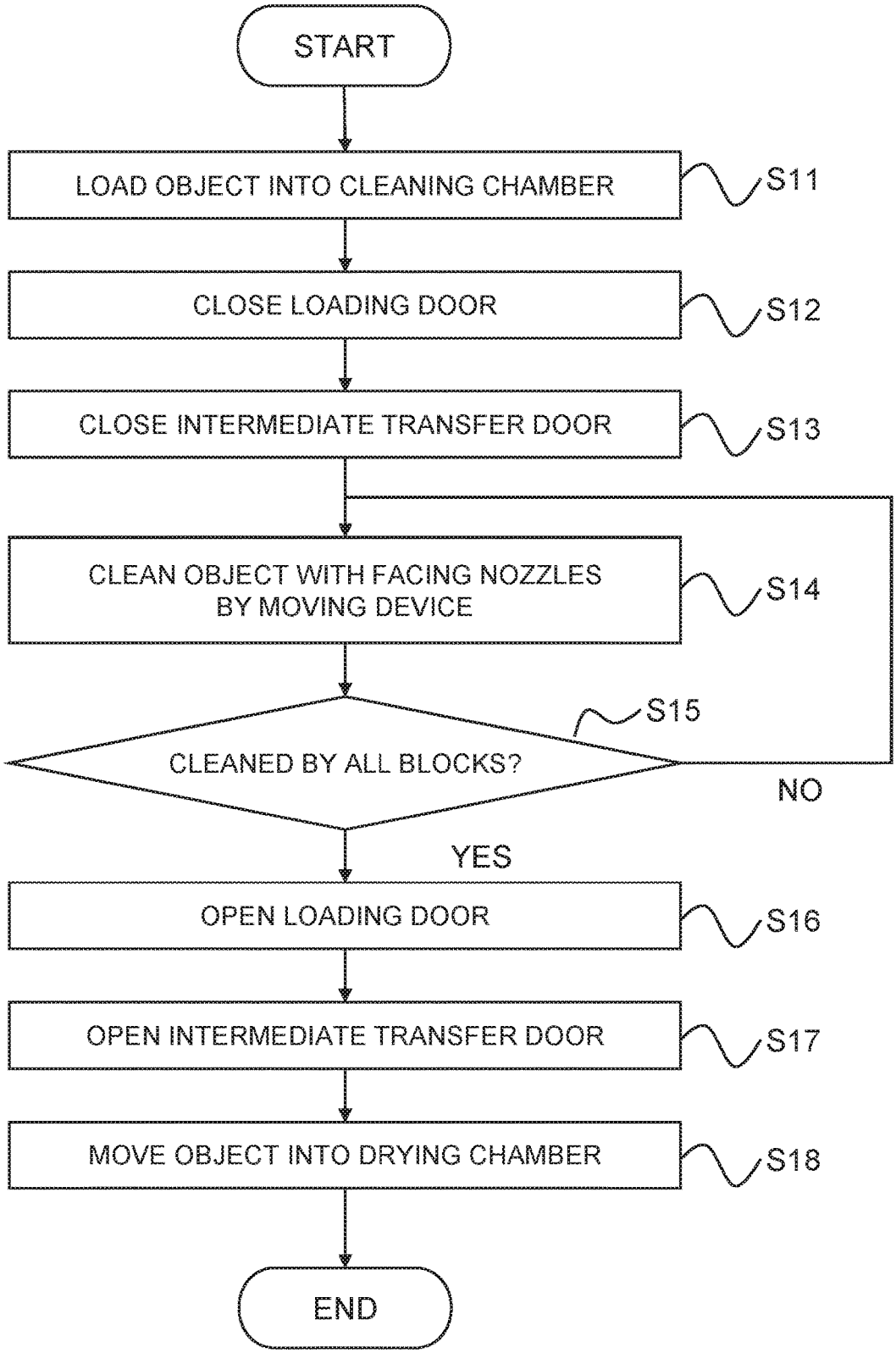
FIG. 7A shows a flow chart of the cleaning methods of the embodiment.

Referring to FIG. 7A, a cleaning method by the cleaning apparatus 10 will be described.

Figure 8:
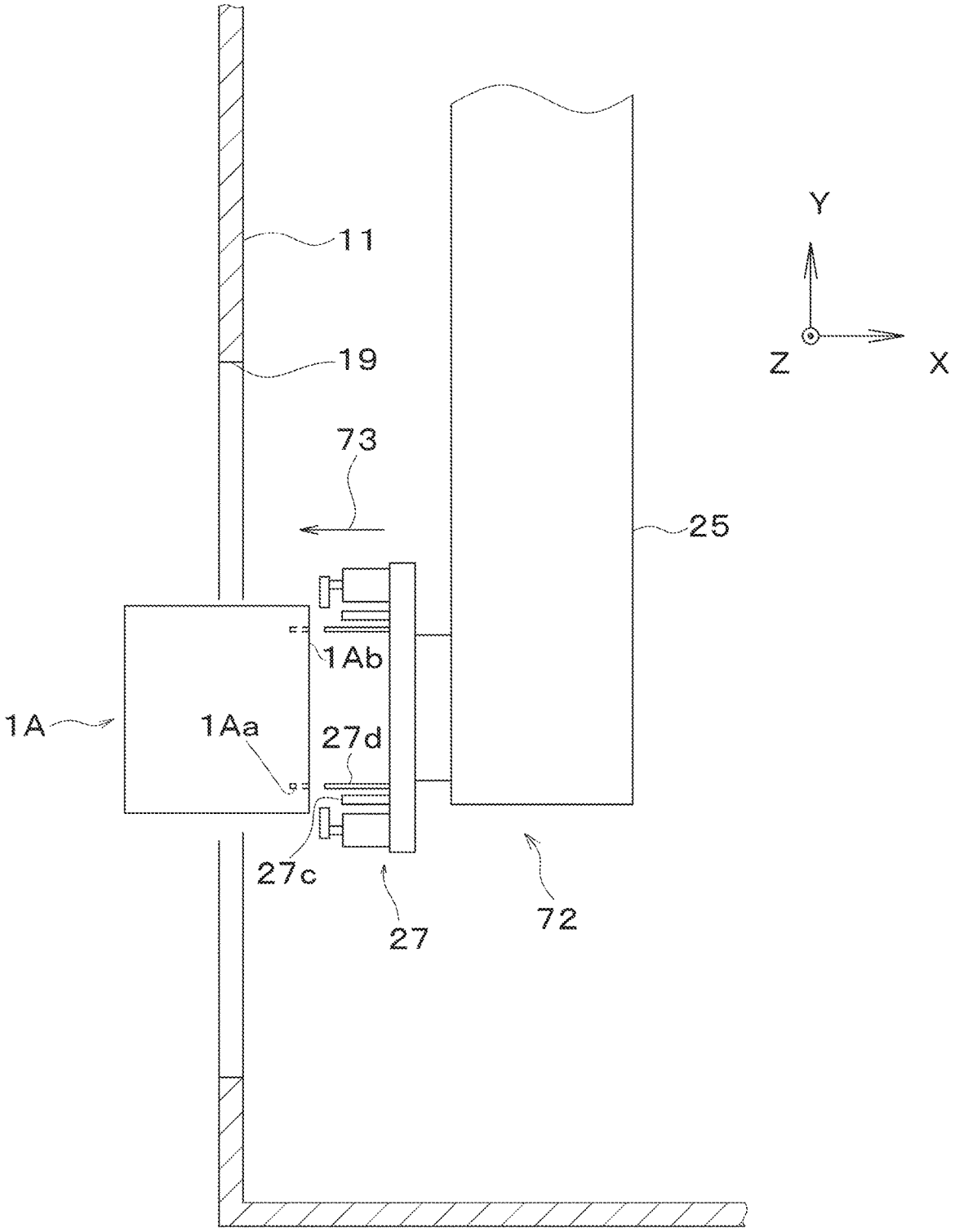
FIG. 8 is a partial plan view showing the moving device of the embodiment picking up an object.

In step S11, the quill 25 grips the object 1 and carries the object 1 into the cleaning chamber 15. As shown in FIG. 8, in a state in which about half of the object 1 is inserted into the loading port 19, a device (not shown) in the preceding process inserts the object 1 into the cleaning apparatus 10. The quill 25 moves the hand 27 to the pick-up position 72. At the position 72, the positioning pin 27*d* is aligned with the pin hole 1Aa. The quill 25 moves object 1 along arrow 73. The positioning pin 27*d* is inserted into the pin hole 1Aa. The seating pin 27*c* is brought into contact with the seating surface 1Ab. The clamp 27*b* clamps the object 1. With the object 1 gripped, the quill 25 completely accommodates the object 1 in the cleaning chamber 15.

Next, in step S12, the loading door 20 is closed. In step S13, the intermediate transfer door 22 is closed. As a result, the cleaning chamber 15 is closed. Steps S12 and S13 may be performed simultaneously.

In step S14, the object 1 is cleaned for each of the blocks 35*a* to 35*c*. Step S14 is repeated for the number of blocks 35*a* to 35*c* in step S15.

The pump 29 is driven to open the valve 31*a*. A cleaning liquid is supplied to the block 35*a*. The nozzles 37*a* jet the cleaning liquid. The quill 25 moves the object 1 along a programmed path 59. The plurality of cleaning points 2 face any one of the nozzles 37*a*. The cleaning liquid ejected from the nozzles 37*a* collides with the cleaning points 2, and the foreign matter in the cleaning points 2 is washed away. After the cleaning, the valve 31*a* is closed. In step S14, the nozzles 37*a* stop jetting the cleaning liquid.

Subsequently, the valve 31*b* is opened. The nozzles 37*b* jet the cleaning liquid. The quill 25 moves the object 1 along a programmed path (not shown). The cleaning liquid ejected from the nozzles 37*b* collides with the cleaning points 2, and the cleaning points 2 is cleaned. Thereafter, the valve 31*b* is closed, and the nozzles 37*b* stop jetting the cleaning liquid in step S14.

Subsequently, the valve 31*c* is opened. The nozzles 37*c* jet the cleaning liquid. The quill 25 moves the object 1 along a programmed path (not shown). The cleaning liquid ejected from the nozzle 37*c* collides with the cleaning points 2, and the cleaning points 2 is cleaned. Thereafter, the valve 31*c* is closed, and the nozzles 37*c* stop jetting the cleaning liquid in step S14.

The order of cleaning by the nozzles 37*a*, 37*b*, 37*c* may be changed.

Next, in step S16, the loading door 20 is opened. In step S17, the intermediate transfer door 22 is opened. Steps S16 and S17 may be performed simultaneously. Then, in step S18, the object 1 is moved to the drying chamber 17. Thereafter, when the object 1 to be cleaned next is loaded into the cleaning chamber 15, the process returns to step S11 again, and the above steps are repeated.

Figure 7B:
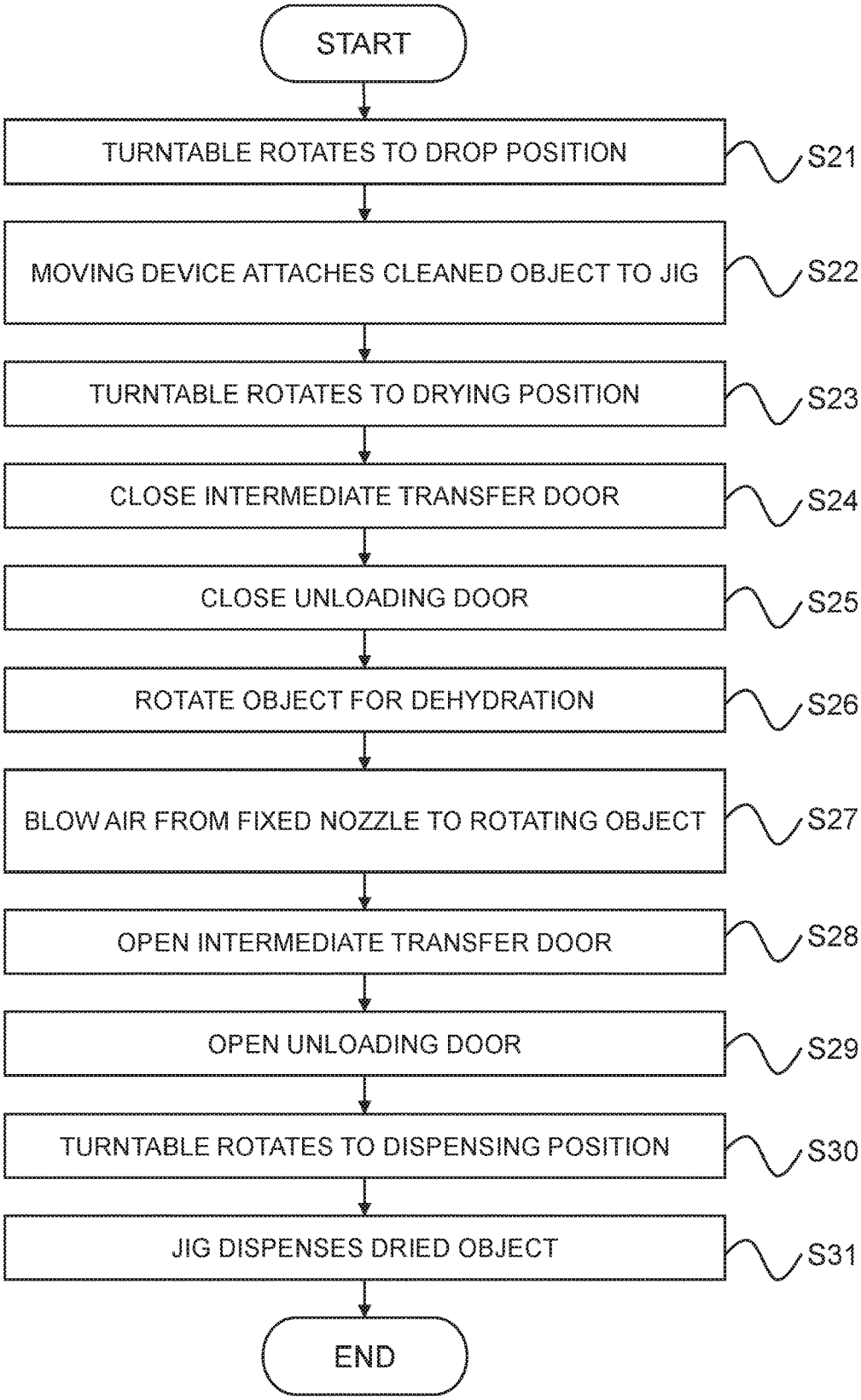
FIG. 7B is a flow chart of the drying method of the embodiment.

Next, referring to FIG. 7B, a drying method will be described.

First, in step S21, the table 41 rotates the jig 43 to the drop position 71.

Figure 9:
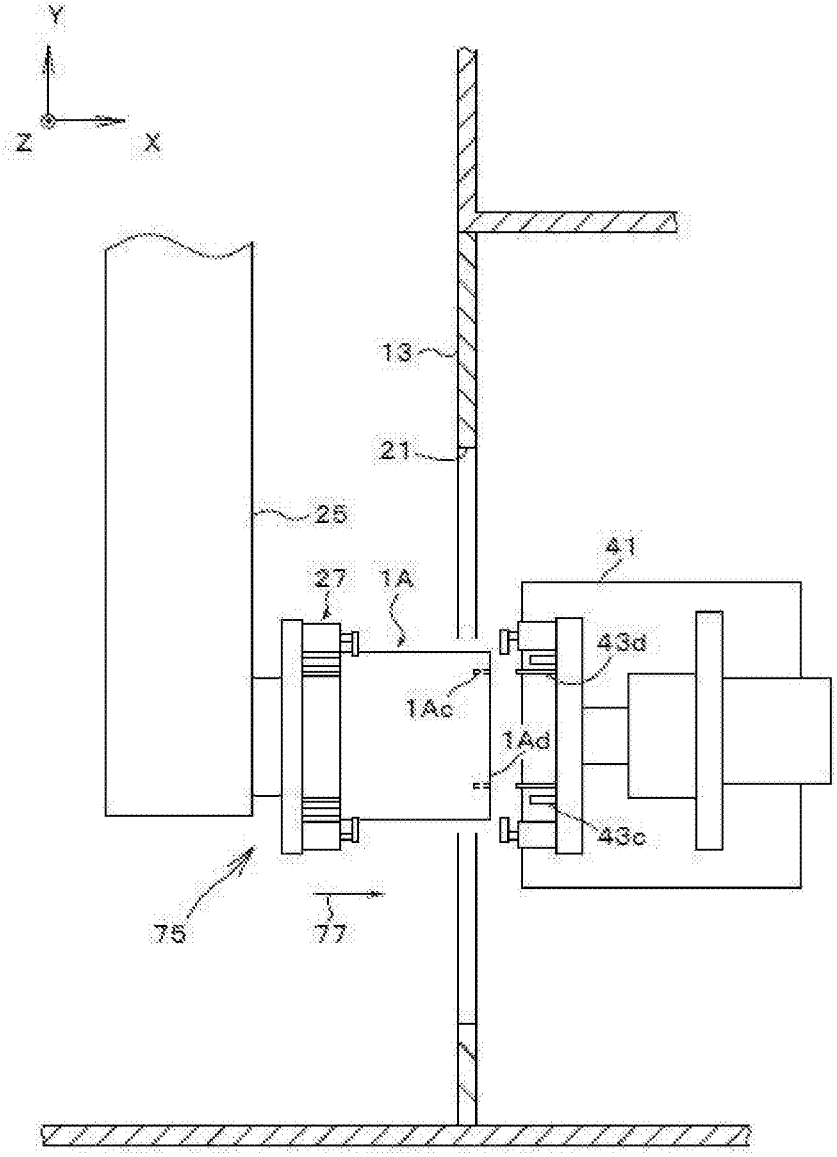
FIG. 9 is a partial plan view showing the moving device of the embodiment dropping the object.

Next, in step S22, the quill 25 attaches the cleaned object 1 to the jig 43. As shown in FIG. 9, the quill 25 moves the hand 27 to the position 75 just before the drop. The quill 25 matches the position and orientation of the hand 27 with the object 1. The quill 25 moves along the arrow 77 so as to insert the positioning pin 27*d* into the pin hole 1Ac. The seating pin 43*c* contacts the seating surface 1Ad. The clamp 43*b* clamps the object 1. The hand 27 then releases the object 1. The quill 25 returns the hand 27 to the position 75 just before the drop.

In step S23, the table 41 rotates the object 1 to the drying position 67. In step S24, the intermediate transfer door 22 is closed. In step S25, the unloading door 24 is closed. Steps S24 and S25 may be performed simultaneously.

In step S26, the motor 63 rotates the rotation shaft 45, the jig 43, and the object 1. Preferably, the object 1 rotates at a rotational speed of 200 to 500 rpm. The cleaning liquid adhering to the object 1 is shaken off by centrifugal force. When the rotation speed becomes 200 rpm or more, the dehydration effect of the object 1 is enhanced.

The blower 55 delivers dry air to the pipe 51. The nozzles 51*a* eject dry air onto the outer surface of the object 1. The cleaning liquid adhering to the outer surface of the object 1 is blown off by dry air.

The blower 55 delivers dry air to the nozzle 49. The nozzle 49 ejects dry air onto the inner surface of the object 1. The cleaning liquid adhering to the inner surface of the object 1 is blown off by dry air.

The blower 55 delivers dry air to the pipe 53. The nozzles 53*a* eject dry air onto the back surface of the object 1. In step S27, the cleaning liquid adhering to the back surface of the object 1 is blown off by dry air.

Steps S26 and S27 may be performed simultaneously. As the object 1 rotates, the dry air ejected from the nozzles 49, 51*a*, and 53*a* is blown to substantially the entire circumference of the object 1.

The drying chamber 17 is separated from the cleaning chamber 15 by a partition plate 13 and a door 22. The cleaning liquid ejected in the cleaning chamber 15 does not enter the drying chamber 17. Steps S26 and S27 for the previously cleaned object 1 and steps S14 and S15 for the later cleaned object 1 may be performed simultaneously. Preferably, the cleaning time and the drying time are substantially the same.

Next, in step S28, the intermediate transfer door 22 is opened. In step S29, the unloading door 24 is opened. Steps S28 and S29 may be performed simultaneously.

In step S30, the table 41 rotates to the dispensing position. Step S30 is performed after step S29. This is because the table 41 can be rotated to the dispensing position 69 by the step S30.

In step S31, the jig 43 dispenses the dried object 1. Specifically, the clamp 43*b* releases the object 1. An apparatus (not shown) in the next step picks up the object 1. The apparatus in the next step is, for example, an assembling apparatus, a carrying-out robot, or the like. The apparatus in the next step picks up the object 1 and moves to a region where the rotating of the table 41 is not hindered. The apparatus in the next step may send a pick-up complete signal to the cleaning apparatus 10. The cleaning apparatus 10 confirms the end of the dispensing.

Thereafter, when the next object 1 to be dried is moved to the drying chamber 17, the process returns to step S21 again, and the above steps are repeated.

When the cleaning and drying of the plurality of objects 1 are performed sequentially, steps S13 and S24, steps S17 and S28, and steps S18 and S22 are the same process.

The present invention is not limited to the embodiments described above, and various modifications can be made without departing from the gist of the present invention, and all technical matters included in the technical idea described in the claims are the subject matter of the present invention. While the foregoing embodiments illustrate preferred examples, those skilled in the art will appreciate that various alternatives, modifications, variations, or improvements may be made in light of the teachings disclosed herein and are within the scope of the appended claims.

REFERENCE SIGNS LIST

1 Object
10 Cleaning apparatus
13 Partition plate
15 Cleaning chamber
17 Drying chamber
19 Loading port
20 Loading door
21 Intermediate transfer port
22 Intermediate transfer door
23 Unloading port
24 Unloading door
25 Quill (moving device)
27 Hand (Gripping Device)
37*a*, 37*b*, 37*c* Nozzles
41 Table (turntable)
43 Jig (gripping device)

What is claimed is:

1. A cleaning apparatus, comprising:

a cover having a cleaning chamber and a drying chamber inside, the cover having a loading port formed on a wall surface of the cleaning chamber, and an unloading port formed on a wall surface of the drying chamber;

a partition plate having an intermediate transfer port, the partition plate dividing a space inside the cover into the cleaning chamber and the drying chamber;

an intermediate door configured to open and close the intermediate transfer port;

a turntable disposed inside the drying chamber, the turntable having a first gripping device configured to grip an object, the turntable configured to rotate to a drop position for receiving the object through the intermediate transfer port, a drying position for drying the object, and a dispensing position for dispensing the object through the unloading port, the first gripping device including a rotating plate fixed to a rotation shaft disposed on the turntable; and a moving device disposed inside the cleaning chamber, the moving device having a second gripping device configured to grip the object through the loading port, the moving device configured to move the object to the first gripping device through the intermediate transfer port.

2. The cleaning apparatus according to claim 1, wherein the moving device grips the object from an outside of the loading port and loads the object into the cover through the loading port.

3. The cleaning apparatus according to claim 1, wherein the turntable is configured so that the object protrudes from the intermediate transfer port with the object gripped by the first gripping device facing the intermediate transfer port, and the object protrudes from the unloading port with the object gripped by the first gripping device facing the unloading port.

4. The cleaning apparatus according to claim 1, further comprising:

a pump configured to supply cleaning liquid; and a plurality of nozzles configured to eject the cleaning liquid, the nozzles connected to the pump, the nozzles arranged on a passing trajectory of a plurality of cleaning points of the object when the object moves inside the cleaning chamber.

5. The cleaning apparatus according to claim 1, wherein the loading port and the unloading port are located on any of a front surface or lateral surface of the cleaning apparatus.

6. The cleaning apparatus according to claim 1, wherein the first gripping device is rotatably disposed on the turntable, and the cleaning apparatus further comprising:

a motor disposed on the turntable, the motor configured to rotate the first gripping device.

7. The cleaning apparatus according to claim 2, wherein the turntable is configured so that the object protrudes from the intermediate transfer port with the object gripped by the first gripping device facing the intermediate transfer port, and the object protrudes from the unloading port with the object gripped by the first gripping device facing the unloading port.

8. The cleaning apparatus according to claim 2, further comprising:

a pump configured to supply cleaning liquid; and a plurality of nozzles configured to eject the cleaning liquid, the nozzles connected to the pump, the nozzles arranged on a passing trajectory of a plurality of cleaning points of the object when the object moves inside the cleaning chamber.

9. The cleaning apparatus according to claim 3, further comprising:

a pump configured to supply cleaning liquid; and a plurality of nozzles configured to eject the cleaning liquid, the nozzles connected to the pump, the nozzles arranged on a passing trajectory of a plurality of cleaning points of the object when the object moves inside the cleaning chamber.

10. The cleaning apparatus according to claim 1, wherein the first gripping device includes a clamp to clamp the object.

11. A cleaning apparatus, comprising:

a cover having a cleaning chamber and a drying chamber inside, the cover having a loading port formed on a wall surface of the cleaning chamber, and an unloading port formed on a wall surface of the drying chamber;

a partition plate having an intermediate transfer port, the partition plate dividing a space inside the cover into the cleaning chamber and the drying chamber;

an intermediate door configured to open and close the intermediate transfer port;

a turntable disposed inside the drying chamber, the turntable having a first gripping device configured to grip an object, the turntable configured to rotate to a drop position for receiving the object through the intermediate transfer port, a drying position for drying the object, and a dispensing position for dispensing the object through the unloading port; and a moving device disposed inside the cleaning chamber, the moving device having a second gripping device configured to grip the object through the loading port, the moving device configured to move the object to the first gripping device through the intermediate transfer port, wherein the turntable is configured so that the object protrudes from the intermediate transfer port with the object gripped by the first gripping device facing the intermediate transfer port, and the object protrudes from the unloading port with the object gripped by the first gripping device facing the unloading port.

12. The cleaning apparatus according to claim 11, wherein the first gripping device includes a clamp to clamp the object.

* * * * *